US009012795B2

(12) United States Patent
Niu

(10) Patent No.: US 9,012,795 B2
(45) Date of Patent: Apr. 21, 2015

(54) STACKED METAL AND ELASTOMERIC DOME FOR KEY SWITCH

(75) Inventor: James J. Niu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 193 days.

(21) Appl. No.: 12/712,102

(22) Filed: Feb. 24, 2010

(65) Prior Publication Data

US 2011/0203912 A1 Aug. 25, 2011

(51) Int. Cl.
*H01H 9/02* (2006.01)
*H01H 3/12* (2006.01)

(52) U.S. Cl.
CPC ..... *H01H 3/125* (2013.01); *H01H 2215/006* (2013.01); *H01H 2215/016* (2013.01); *H01H 2227/034* (2013.01)

(58) Field of Classification Search
CPC . H01H 13/14; H01H 2221/044; H01H 13/52; H01H 3/12; H01H 13/85; H01H 2215/004; H01H 3/125; H01H 2223/003; H01H 2227/034; H01H 13/48; H01H 2203/038
USPC ..... 200/341, 344, 406, 517
See application file for complete search history.

(56) References Cited

U.S. PATENT DOCUMENTS

| | | | | |
|---|---|---|---|---|
| 4,378,478 | A | 3/1983 | Deeg | |
| 5,199,557 | A * | 4/1993 | Brandt et al. | 200/406 |
| 5,340,955 | A * | 8/1994 | Calvillo et al. | 200/302.2 |
| 5,510,584 | A * | 4/1996 | Norris | 200/5 A |
| 5,602,715 | A * | 2/1997 | Lempicki et al. | 361/679.13 |
| 5,664,667 | A * | 9/1997 | Kenmochi | 200/314 |
| 6,084,190 | A * | 7/2000 | Kenmochi | 200/341 |
| 6,307,537 | B1 * | 10/2001 | Oowada | 345/160 |
| 6,750,415 | B2 * | 6/2004 | Yamagami | 200/517 |
| 6,894,626 | B2 * | 5/2005 | Olodort et al. | 341/22 |
| 7,109,431 | B2 * | 9/2006 | Yanai et al. | 200/512 |
| 7,217,893 | B1 * | 5/2007 | Huang et al. | 200/1 B |
| 7,301,113 | B2 | 11/2007 | Nishimura et al. | |
| 8,258,418 | B2 * | 9/2012 | Chen | 200/302.1 |
| 2006/0042923 | A1 | 3/2006 | De Richecour et al. | |
| 2007/0091070 | A1 * | 4/2007 | Larsen et al. | 345/168 |
| 2009/0166165 | A1 | 7/2009 | Aoki et al. | |
| 2009/0250329 | A1 | 10/2009 | Yu et al. | |

FOREIGN PATENT DOCUMENTS

| | | |
|---|---|---|
| JP | 2003-249144 | 9/2003 |
| WO | WO 2006/073263 | 7/2006 |

* cited by examiner

*Primary Examiner* — Xuong Chung Trans
(74) *Attorney, Agent, or Firm* — Brownstein Hyatt Farber Schreck, LLP

(57) ABSTRACT

A low travel keyboard and methods of fabrication are described. The low-travel keyboard is suitable for a thin-profile computing device, such as a laptop computer, netbook computer, desktop computer, etc. The keyboard includes a key cap positioned over stacked elastomeric and metal domes. The quick force drop of the metal dome provides the crisp "snappy" feel for the user and the elastomeric dome provides the ability for longer travel than the metal dome alone. The metal dome also activates the switch circuitry of the membrane on printed circuit board. The stacking of the elastomeric metal domes takes advantage of the abrupt force drop in the metal dome buckling and applies it to the elastomeric dome force, making it possible to design a low-travel key while still maintaining or improving the tactile feeling of the key switch.

21 Claims, 7 Drawing Sheets

STACKED METAL AND ELASTOMERIC DOME FOR KEY SWITCH

BACKGROUND OF THE INVENTION

1. Field of the Invention

The described embodiments relate generally to peripheral devices for use with computing devices and similar information processing devices. More particularly, the present embodiments relate to keyboards for computing devices and methods of assembling the keyboards of computing devices.

2. Description of the Related Art

Keyboards are used to input text and characters into the computer and to control the operation of the computer. Physically, computer keyboards are an arrangement of rectangular or near-rectangular buttons or "keys," which typically have engraved or printed characters. In most cases, each depressing of a key corresponds to a single symbol. However, some symbols require that a user depresses and holds several keys simultaneously, or in sequence. Depressing and holding several keys simultaneously, or in sequence, can also result in a command being issued that affects the operation of the computer, or the keyboard itself.

There are several types of keyboards, usually differentiated by the switch technology employed in their operation. The choice of switch technology affects the keys' responses (i.e., the positive feedback that a key has been depressed) and travel (i.e., the distance needed to push the key to enter a character reliably). One of the most common keyboard types is a "dome-switch" keyboard, which works as described below. When a key is depressed, the key pushes down on a rubber dome sitting beneath the key. The rubber dome collapses, which gives tactile feedback to the user depressing the key, and cause a conductive contact on the underside of the dome to touch a pair of conductive lines on the printed circuit board (PCB) below the dome, thereby closing the switch. A chip in the keyboard emits a scanning signal along the pairs of lines on the PCB to all the keys. When the signal in one pair of lines changes due to the contact, the chip generates a code corresponding to the key connected to that pair of lines. This code is sent to the computer either through a keyboard cable or over a wireless connection, where it is received and decoded into the appropriate key. The computer then decides what to do based on the particular key depressed, such as display a character on the screen, or perform some other type of action. Other types of keyboards operate in a similar manner, with the main difference being how the individual key switches work. Some examples of other keyboards include capacitive keyboards, mechanical-switch keyboards, Hall-effect keyboards, membrane keyboards, roll-up keyboards, and so on.

The outward appearance, as well as functionality, of a computing device and its peripheral devices is important to a user of the computing device. In particular, the outward appearance of a computing device and peripheral devices, including their design and its heft, is important, as the outward appearance contributes to the overall impression that the user has of the computing device. One design challenge associated with these devices, especially with portable computing devices, generally arises from a number conflicting design goals that includes the desirability of making the device lighter and thinner while maintaining user functionality.

Therefore, it would be beneficial to provide a keyboard for a computing device that is thin and aesthetically pleasing, yet still provides the tactile feel to which users are accustomed. It would also be beneficial to provide methods for manufacturing the keyboard having a reduced thickness for the computing device.

SUMMARY OF THE DESCRIBED EMBODIMENTS

This paper describes various embodiments that relate to systems, methods, and apparatus for providing a low-travel keyboard that provides tactile feedback for use in thin-profile computing applications.

According to one embodiment, a keyboard for a computing device is described. The keyboard includes at least a metal dome and an elastomeric dome disposed over the metal dome. A key cap is disposed over the elastomeric dome and the metal dome can activate electrical switch circuitry below the metal dome when the metal dome is deformed. In an embodiment, the key cap deforms the elastomeric dome when a user pushes down on the key cap, and the elastomeric dome then deforms the metal dome in a serial fashion. In another embodiment, the key cap deforms both the elastomeric dome and the metal dome in a parallel fashion. The combination of the elastomeric and metal domes can provide a positive tactile response for the user while reducing the travel distance of the keyboard.

A method of assembling the key switch is disclosed. The method can be carried out by the following operations: providing a membrane having electrical switch circuitry, disposing a metal dome over the membrane, disposing an elastomeric dome over the metal dome, and positioning a key cap over the elastomeric dome. A scissor mechanism can also be included to provide additional mechanical stability. The metal dome is positioned over the membrane such that the metal dome contacts the membrane to close the switch when the metal dome is deformed.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF SELECTED EMBODIMENTS

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as may be included within the spirit and scope of the described embodiments as defined by the appended claims.

Figure 1:
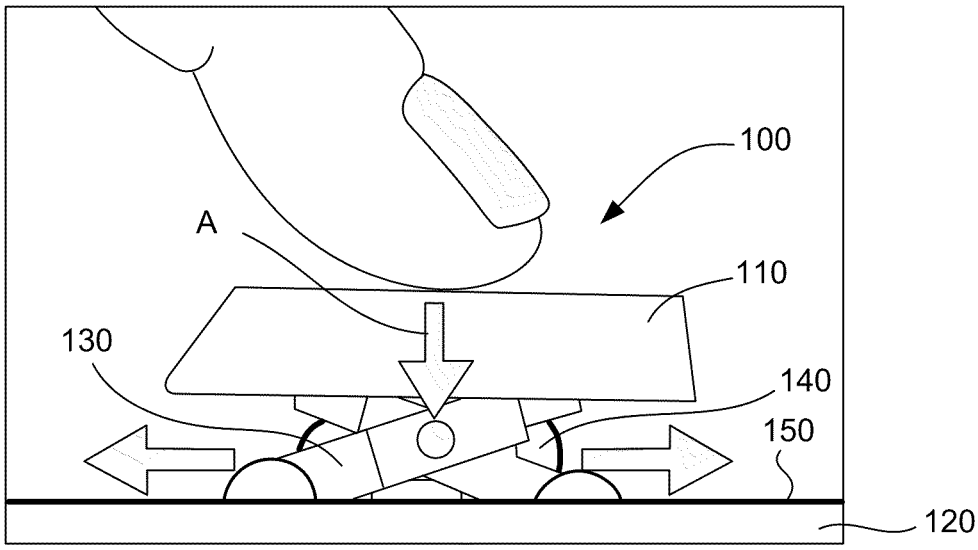
FIG. 1 is a side view of a typical key switch of a scissor-switch keyboard.

FIG. 1 is a side view of a typical key switch 100 of a scissor-switch keyboard. A scissor-switch keyboard is a type of relatively low-travel dome-switch keyboard that provides the user with good tactile response. Scissor-switch keyboards typically have a shorter total key travel distance, which is about 2 mm per key stroke instead of about 3.5-4 mm for standard dome-switch key switches. Thus, scissor-switch type keyboards are usually found on laptop computers and other "thin-profile" devices. The scissor-switch keyboards are generally quiet and require relatively little force to press.

As shown in FIG. 1, the key cap 110 is attached to the base plate or PCB 120 of the keyboard via a scissor-mechanism 130. The scissor-mechanism 130 includes two pieces that interlock in a "scissor"-like manner, as shown in FIG. 1. The scissor-mechanism 130 is typically formed of a rigid material, such as plastic or metal or composite material, as it provides mechanical stability to the key switch 100. As illustrated in FIG. 1, a rubber dome 140 is provided. The rubber dome 140, along with the scissor-mechanism 130, supports the key cap 110.

When the key cap 110 is pressed down by a user in the direction of arrow A, it depresses the rubber dome 140 underneath the key cap 110. The rubber dome 140, in turn, collapses, giving a tactile response to the user. The rubber dome also dampens the keystroke in addition to providing the tactile response. The rubber dome 140 can contact a membrane 150, which serves as the electrical component of the switch. The collapsing rubber dome 140 closes the switch when it depresses the membrane 150 on the PCB, which also includes a base plate 120 for mechanical support. The total travel of a scissor-switch key is shorter than that of a typical rubber dome-switch key. As shown in FIG. 1, the key switch 100 includes a three-layer membrane 150 (on a PCB) as the electrical component of the switch. The membrane 150 can be a three-layer membrane or other type of PCB membrane, which will be described in more detail below.

The following description relates to a low-travel keyboard suitable for a thin-profile computing device, such as a laptop computer, netbook computer, desktop computer, etc. The keyboard can include a key cap positioned over stacked elastomeric and metal domes. The elastomeric dome can be formed of a material, such as silicone or polyester. The metal dome can be formed of a material, such as stainless steel. Stainless steel has a number of characteristics that make it a good choice for the metal dome. For example, stainless steel is durable and fairly resistant to corrosion, and it is a relatively inexpensive metal that can be easily machined and has well known metallurgical characteristics. Furthermore, stainless steel can be recycled. In some embodiments, the stainless steel metal dome can be plated with gold, silver, or nickel.

These and other embodiments of the invention are discussed below with reference to FIGS. 2-7. However, those skilled in the art will readily appreciate that the detailed description given herein with respect to these figures is for explanatory purposes as the invention extends beyond these limited embodiments.

Figure 2:
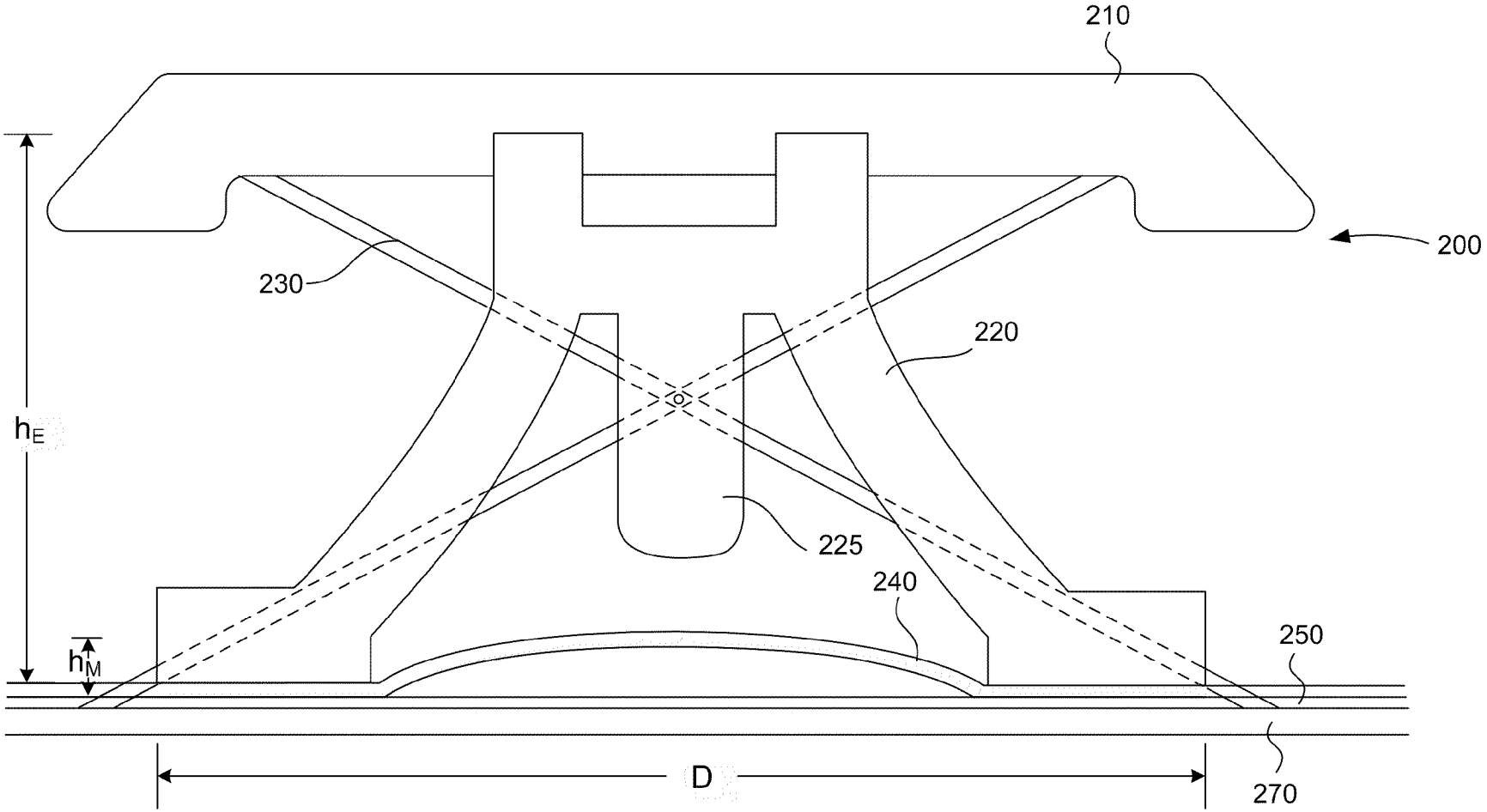
FIG. 2 is a side view of an embodiment of a key switch of a scissor-switch keyboard having stacked metal and elastomeric domes underneath a key cap.

FIG. 2 is a side view of an embodiment of a key switch 200 of a scissor-switch keyboard having stacked metal and elastomeric domes underneath a key cap 210. According to an embodiment, the key switch 200 has quick tactile force drop and low travel of less than about 1.5 mm, with a peak force in the range of about 50 grams to about 70 grams. In other embodiments, the key switch 200 has a total travel in a range of about 1.0 mm to about 1.5 mm. In other embodiments, the key switch 200 has a total travel of less than about 1 mm. In still other embodiments, the key switch 200 has a total travel in a range of about 0.7 mm to about 1.0 mm.

As mentioned above, it is desirable to make the keyboard (and computing device) thinner, but users still want the tactile feel to which users are accustomed. It is desirable for the keys to have some "bounce-back" or "snappy" feel. As can be appreciated by the skilled artisan, substantially flat keyboards, such as membrane keyboards, do not provide the tactile feel that is desirable for a keyboard. Similarly, simply reducing the travel of a typical rubber dome scissor-switch keyboard also reduces the tactile or "snappy" feel that a conventional dome-switch keyboard provides.

Figure 3:
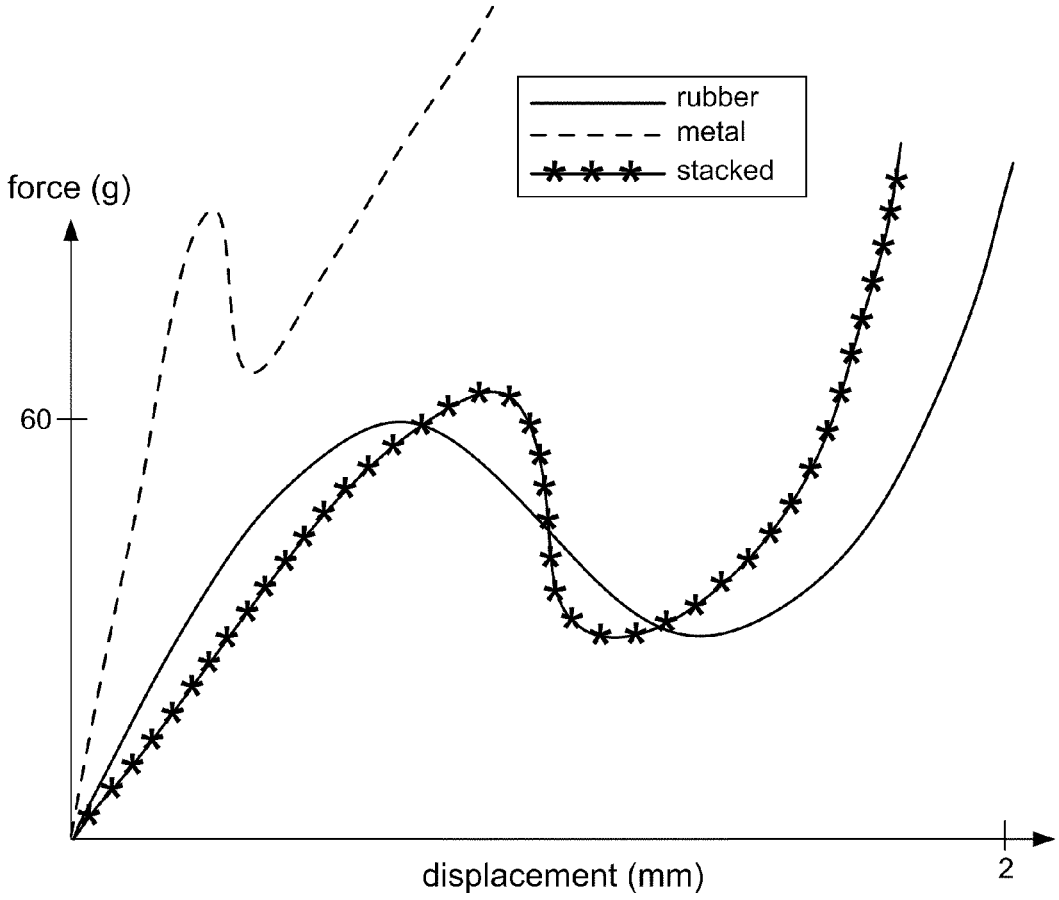
FIG. 3 is a graph showing a comparison of displacement curves for a rubber dome, a metal dome, and stacked rubber and metal domes.

FIG. 3 is a graph showing a comparison of displacement curves for a rubber dome, a metal dome, and stacked rubber and metal domes. As shown in FIG. 3, a typical rubber dome can provide a buildup of force from zero to peak force at around 60 grams, and then buckle down to about 40 grams, but the distance (amount of travel) from peak to bottom is typically about 0.5 mm. It will be understood that the force drop occurs when the rubber dome buckles. Due to the long travel involved, the total travel cannot be reduced for low travel keyboard design without compromising tactile feel. The skilled artisan will appreciate that the displacement curves shown in FIG. 3 are exemplary curves, and that the actual amount of force and displacement will depend on the particular materials and thicknesses of the domes.

The skilled artisan will readily appreciate that metal domes can provide very low travel as well as a crisp tactile feel. Like a rubber dome, a metal dome also dampens the keystroke in addition to providing a very crisp tactile response to the user. A metal dome typically has a good tactile force drop with a relatively short travel distance, which is typically about 0.1-0.2 mm. As shown in FIG. 3, the displacement curve of the metal dome shows that the metal dome has a quick force drop over a short travel distance relative to the rubber dome.

As illustrated by the comparison of the displacement curves in FIG. 3, rubber domes lack the quick force drop and therefore the crisp snap of metal domes. Thus, rubber domes do not provide the positive crisp tactile response of metal domes, especially when the amount of travel is reduced. However, although a metal dome can provide a positive crisp tactile feel, a metal dome alone cannot provide the desired tactile feel and travel distance for a keyboard suitable for typing or otherwise inputting text. The skilled artisan will appreciate that a metal dome cannot achieve travel greater than about 0.7 mm, as the metal is difficult to deform and would require a large amount of force for deformation. Even if enough force were applied to the metal dome, it would not be able to achieve travel greater than about 0.7 mm unless the metal dome is quite large. A larger metal dome would cause each individual key to also be quite large, which can be undesirable and impractical, especially in portable devices.

FIG. 3 also illustrates a displacement curve for an embodiment having stacked elastomeric and metal domes, such as the one shown in FIG. 2. As shown in FIG. 3, the displacement curve of the stacked domes is very similar to that of the rubber dome itself. The force drops are similar, indicating the tactile feel of the stacked domes and that of the rubber dome alone are also similar. However, the displacement or amount of travel is reduced for the stacked domes.

Figure 4:
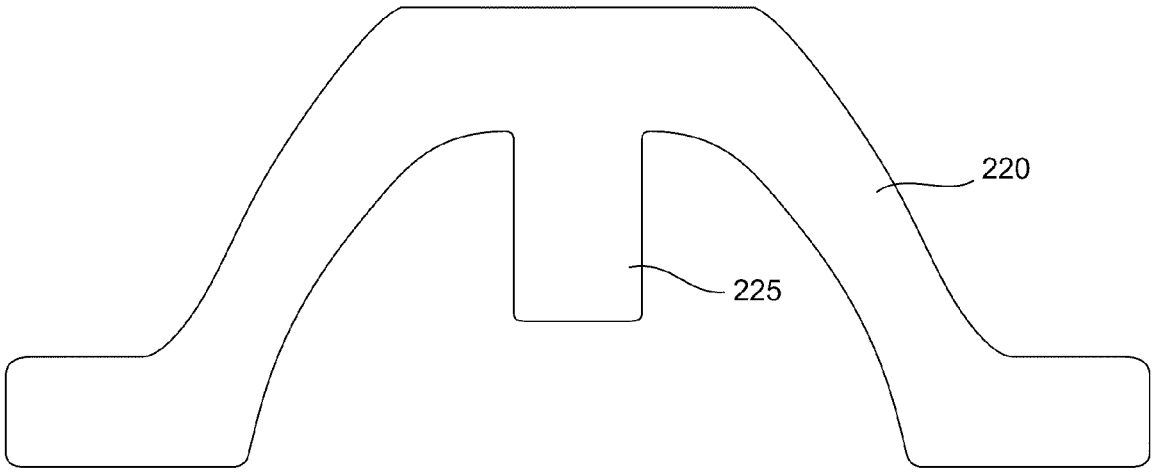
FIG. 4 is a side view of an alternative design for the elastomeric dome of a key switch of a scissor-switch keyboard having stacked metal and elastomeric domes underneath a key cap.

According to the embodiments shown in FIGS. 2-4, an elastomeric or rubber dome is positioned or stacked over a metal dome. The combination of the elastomeric dome with the metal dome allows the key to have a travel distance of less than 1.5 mm while maintaining the positive tactile feedback that is desirable for a keyboard, as will be explained in more detail below. As shown in FIG. 2, the domes are substantially concave or hemispherical and oriented in the same direction, with the vertex of each of the domes being at the highest point. In other words, the elastomeric dome is stacked over the metal dome with the dome openings facing downward. As the domes are concave, they are normally-open tactile switches. The switch only closes when the domes are collapsed, as will be described in more detail below. It will be understood that although the illustrated embodiments show substantially hemispherical domes, the elastomeric and metal structures, in other embodiments, may also have other shapes, including, for example, rectangular or box shape, conical, truncated conical, and other shapes capable of similar deformation from the typical force applied to a key pad.

The embodiment illustrated in FIG. 2 can include a scissor mechanism 230. Additional support and mechanical stability for the key switch can be provided by the scissor mechanism 230. In this embodiment, the elastomeric dome 220 provides the ability for longer travel. The metal dome 240 provides the majority of the tactile force drop and also activates the switch circuitry of the membrane 250 on the base plate 270. The abrupt or quick force drop of the metal dome 240 provides the crisp "snappy" feel for the user. The stacking of the elastomeric dome 220 and the metal dome 240 takes advantage of the abrupt force drop in the metal dome buckling and applies it to the elastomeric dome force, making it possible to design a low-travel key while still maintaining or improving the tactile feeling of the key switch. It provides the kind of force drop that an elastomeric dome alone cannot achieve, and also the initial compliancy and force build-up that are absent in metal domes. As shown in FIG. 2, the diameters of the elastomeric dome 220 and the metal dome 240 are substantially the same.

When a user presses down on the key cap 210, it depresses and collapses the elastomeric dome 220 and can collapse a scissor mechanism 230. The elastomeric dome 220 can include a plunger portion 225 that extends downward from the center of the underside of the elastomeric dome 220. As shown in FIG. 2, the plunger 225 portion of the elastomeric dome 220 is positioned directly over the center of the top of the metal dome 240. Thus, when the elastomeric dome 220 compresses, the plunger 225 then contacts and pushes down on the center of the top of the metal dome 240, and collapses the metal dome 240. As shown in FIG. 2, the plunger 225 is a portion of the elastomeric dome 220 that does not contact the metal dome 240 when the elastomeric dome 220 is in a relaxed state. The underside of the center of the collapsing metal dome 240 contacts the top side of the top layer 252 (FIG. 6) of the membrane 250, thereby causing the contact pads 258 of the circuit traces (FIG. 6) on the top layer 252 (FIG. 6) and the bottom layer 256 (FIG. 6) of the membrane 250 to connect and close the switch, which completes the connection to enter the character. As shown in FIG. 2, the membrane 250 is secured to a base plate or PCB 270.

According to an embodiment, the elastomeric dome 220 has a height $h_E$ in a range of about 2 mm to about 4 mm, and the metal dome 240 has a height $h_M$ in a range of about 0.3 mm to about 0.7 mm. According to another embodiment, the elastomeric dome 220 has a height $h_E$ in a range of about 2 mm to about 3 mm, and the metal dome 240 has a height $h_M$ in a range of about 0.3 mm to about 0.5 mm. In still another embodiment, the elastomeric dome 220 has a height $h_E$ in a range of about 3 mm to about 4 mm, and the metal dome 240 has a height $h_M$ in a range of about 0.5 mm to about 0.7 mm.

In an embodiment, the elastomeric dome 220 has a thickness in a range of about 0.2 mm to about 0.6 mm, and the metal dome 240 has a thickness in a range of about 0.03 mm to about 0.1 mm. It will be understood that the metal dome 240 typically has a uniform thickness if it is formed from a sheet of metal. The elastomeric dome 220, however, can have a non-uniform thickness. The skilled artisan will appreciate that the thicknesses of the domes 220, 240 can be adjusted and/or varied to obtain the desired force drop. The base diameter D of the domes can be in the range of about 3 mm to 7 mm.

According to an embodiment, as shown in FIG. 2, the metal dome 240 can be secured, at its base in its non-concave portions, to the membrane 250 by means of adhesive, including pressure-sensitive adhesive tape. The base portion of the elastomeric dome 220 can be secured to the base portion of the metal dome 240. The elastomeric dome 220 can be secured to the metal dome 240 using adhesive. The scissor mechanism 230 can be secured to the base plate 270. In one embodiment, the scissor mechanism 240 has a locking feature that can be snapped into a corresponding feature in the base plate 270. In an alternative embodiment, the metal dome 240 is not adhered to the membrane 250, but is instead encapsulated by an additional membrane sheet that extends over the metal dome and is adhered to the membrane 250.

According to the embodiment shown in FIG. 2, the elastomeric dome 220 is stacked over the metal dome 240. Thus, in this embodiment, the spring force acts in series. According to the serial design of FIG. 2, the key cap 210 directly contacts only the elastomeric dome 220 and not the metal dome 240. When the elastomeric dome 220 collapses, the plunger 225 on the elastomeric dome 220 contacts the metal dome 240 and collapses the metal dome 240.

An alternative design for the elastomeric dome 220 is illustrated in FIG. 4. The skilled artisan will appreciate that the shapes of both the elastomeric dome 220 and metal dome 240 can be modified to achieve the desired tactile characteristics for the keyboard. Similar to the embodiment shown in FIG. 2, the elastomeric dome 220 of the embodiment shown in FIG. 4 also has a plunger 225 portion that does not contact the metal dome 240 until the elastomeric dome 220 is in a collapsed state.

Figure 5:
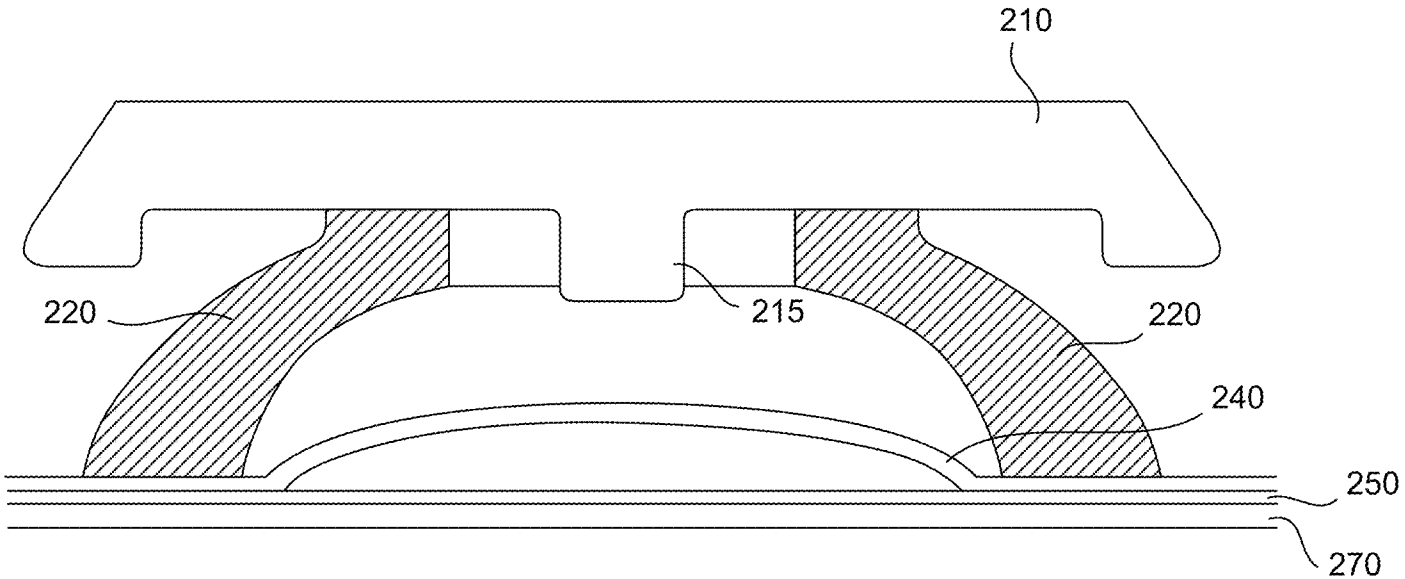
FIG. 5 is a side view of an embodiment of a key switch of a scissor-switch keyboard having stacked metal and elastomeric domes in a parallel design.

Alternatively, a parallel design instead of a serial design may be implemented by engaging the two domes independently. The embodiment shown in FIG. 5 is an example of such a parallel design. The key cap 210, according to this embodiment, includes a plunger portion 215. The resulting force achieved in such a parallel design can be similar to that of the serial designs shown in FIGS. 2 and 4, but the key cap 210 can contact both the elastomeric dome 220 and the metal dome 240 at the same time when the key cap 210 is depressed. Although the parallel design can be more difficult to design, it can allow more precise control of the timing of the force drop. In the parallel design, the peak forces can be adjusted independently, and the resultant force is the sum of the two forces with no interaction between the two forces. It will be understood that, for clarity, the scissor mechanism is not shown in FIG. 5, but that it can be included to provide additional mechanical stability.

Figure 6:
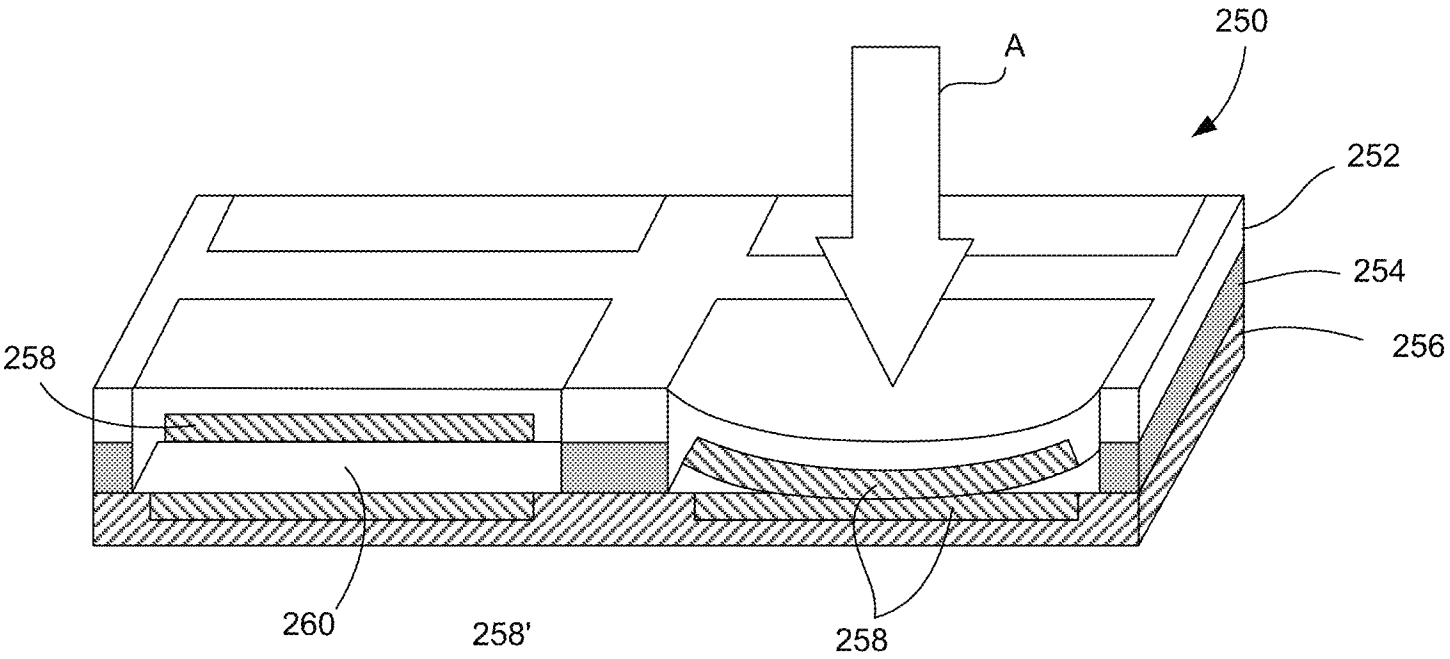
FIG. 6 is a detailed perspective view of an embodiment of a three-layer membrane of a printed circuit board.

FIG. 6 is a detailed perspective view of an embodiment of the membrane 250. According to an embodiment, the membrane 250 can have three layers, including a top layer 252, a bottom layer 256, and a spacer layer 254 positioned between the top layer 252 and the bottom layer 256. The top layer 252 and the bottom layer 256 can include conductive traces and their contact pads 258 on the underside of the top layer 252 and on the top side of the bottom layer 256, as shown in FIG.

6. The conductive traces and contact pads 258 can be formed of a metal, such as silver or copper. As illustrated in FIG. 6, the membrane sheet of the spacer layer 254 includes voids 260 to allow the top layer 252 to contact the bottom layer 256 when the metal dome 240 is collapsed. According to an embodiment, the top layer 252 and bottom layer 256 can each have a thickness of about 0.075 μm. The spacer layer 254 can have a thickness of about 0.05 μm. The membrane sheets forming the layers of the membrane 250 can be formed of a plastic material, such as polyethylene terephthalate (PET) polymer sheets. According to an embodiment, each PET polymer sheet can have a thickness in the range of about 0.025 mm to about 0.1 mm.

Under "normal" conditions when the key pad is not depressed by a user (as shown on the left side of FIG. 6), the switch is open because the contact pads 258 of the conductive traces are not in contact. However, when the top layer 252 is pressed down by the metal dome 240 in the direction of arrow A (as shown on the right side of FIG. 6), the top layer 252 makes contact with the bottom layer 256. The contact pad 258 on the underside of the top layer 252 can then contact the contact pad 258 on the bottom layer 256, thereby allowing the current to flow. The switch is now "closed", and the computing device can then register a key press, and input a character or perform some other operation. It will be understood that other types of switch circuitry can be used instead of the three-layer membrane 250 described above.

According to an embodiment, 5-10 grams of force is enough for the top layer 252 and the bottom layer 256 of the membrane sheets to contact. The point on the displacement curve, as shown in FIG. 3, where the membrane sheets contact is known as the "make point." The bottom of each the curves shown in FIG. 3 is where the collapsed dome, whether rubber or metal, touches the membrane. Thus, the skilled artisan will appreciate that it is desirable for the make point to be very close to the bottom of the curve.

In some embodiments, the key cap 210 is surface-marked. In other embodiments, the key cap 210 can be laser-cut, two-shot molded, engraved, or formed of transparent material with printed inserts.

Figure 7:
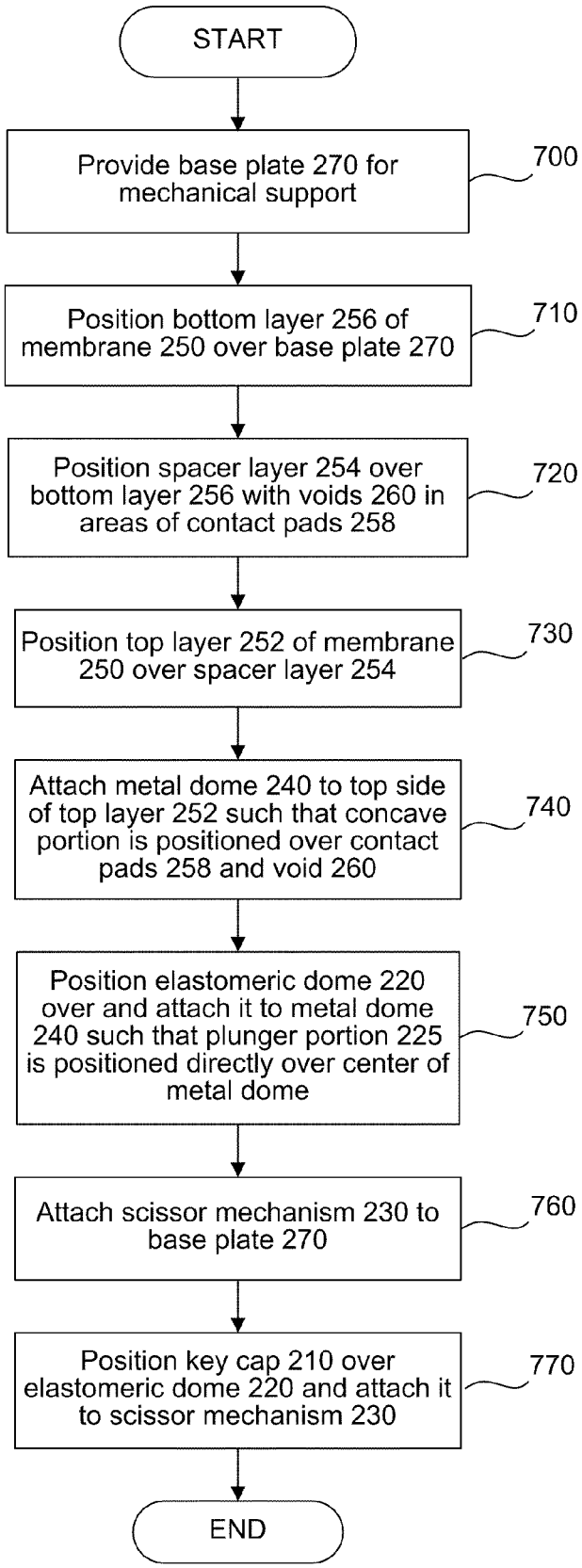
FIG. 7 is a flow chart of a method of assembling an embodiment of a key switch.

A process for assembling the key switch 200, such as the one shown in FIG. 2, will be described with reference to FIG. 7. A process for assembling the components of the key switch 200 will be described below with reference to steps 700-770. In step 700, a base plate 270 is provided for mechanical support for the PCB as well as the entire key switch 200. In one embodiment, the base plate 270 is formed of stainless steel. In other embodiments, the base plate 270 can be formed of aluminum. According to an embodiment, the base plate 260 has a thickness in a range of about 0.2 mm to about 0.5 mm.

A process for forming the three-layer membrane 250 on the base plate 270 will be described below with reference to steps 710-730. In step 710, the bottom layer 256 of the membrane 250 can be positioned over the base plate 270. Next, in step 720, the spacer layer 254 can be positioned over the bottom layer 256 such that the voids 260 are in the areas of the contact pads 258. In step 730, the top layer 252 can be positioned over the spacer layer 254 such that the contact pads 258 on the underside of the top layer 252 are positioned directly over the contact pads 258 on top side of the bottom layer 256 so that they can contact each other when the metal dome 240 is deformed. The layers 252, 254, 256 can be laminated together with adhesive. It will be understood that steps 710-730 can be combined into a single step by providing a three-layer membrane 250 that is pre-assembled or pre-laminated. The membrane 250 is positioned over the base plate 270 and held in place by one or more other components of the key switch 200, such as the scissor mechanism 230.

According to this embodiment, in step 740, the metal dome 240 can be attached to the top side of the top layer 252 of the membrane 250 such that the concave dome portion is positioned over the contact pads 258 and the void 260. In step 750, the elastomeric dome 220 is positioned over and attached to the metal dome 240 such that the plunger portion 225 is positioned directly over the center of the metal dome 240.

In this embodiment, the scissor mechanism 230 is then attached to the base plate 270 in step 760. In step 770, to complete the key switch 200, the key cap 210 is positioned over the elastomeric dome 220 and the scissor mechanism 230, and attached to the scissor mechanism 230.

The advantages of the invention are numerous. Different aspects, embodiments or implementations may yield one or more of the following advantages. One advantage of the invention is that a low-travel keyboard yet may be provided for a thin-profile computing device without compromising the tactile feel of the keyboard. The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

The many features and advantages of the described embodiments are apparent from the written description and, thus, it is intended by the appended claims to cover such features and advantages. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A keyboard for a computing device, comprising:

at least one key comprising a key cap;

an elastomeric dome comprising a first base portion and a plunger portion, the elastomeric dome being attached to and extending from an underside of the key cap; and a metal dome comprising a dome portion and a second base portion, the second base portion being attached to the first base portion of the elastomeric dome, the second base portion of the metal dome being configured to attach to a membrane comprising a top layer having a first contact attached to an underside of the top layer, a bottom layer having a second contact attached to a top side of the bottom layer, and a spacer layer between the top and bottom layers having a void between the first and second contacts, the metal dome being disposed beneath the elastomeric dome and with respect to the elastomeric dome such that when the at least one key is fully depressed, the elastomeric dome collapses and the plunger portion of the elastomeric dome deflects the dome portion of the metal dome to collapse the metal dome into contact with the top layer of the membrane to connect the first and second contacts and when the elastomeric dome is in a relaxed state the plunger portion of the elastomeric dome does not contact the dome portion of the metal dome.

2. The keyboard of claim 1, wherein a distance traveled by the key is less than about 1.5 mm.

3. The keyboard of claim 2, wherein the distance traveled by the key is less than about 1.0 mm.

4. The keyboard of claim 1, wherein the elastomeric dome and the metal dome have a diameter that is substantially the same.

5. The keyboard of claim 1, wherein the key cap contacts the elastomeric dome but not the metal dome when the key cap is depressed.

6. The keyboard of claim 1, further comprising a scissor mechanism attaching the key cap to the membrane.

7. The keyboard of claim 1, wherein the elastomeric dome comprises a hemispherical dome.

8. A method of assembling at least a portion of a low-travel keyboard having a quick force drop for a computing device, the method comprising:

providing a metal dome comprising a dome portion and a first base portion, the first base portion of the metal dome being attachable to a membrane comprising a top layer having a first contact attached to an underside of the top layer, a bottom layer having a second contact attached to a top side of the bottom layer, and a spacer layer between the top and bottom layers having a void between the first and second contacts, the metal dome being collapsible when depressed from above, the metal dome being configured to contact the top layer of the membrane to connect the first and second contacts when the metal dome is deformed;

disposing an elastomeric dome over the metal dome, the elastomeric dome comprising a second base portion and a plunger portion, the second base portion of the elastomeric dome being attached to the first base portion of the metal dome, the elastomeric dome being collapsible when depressed from above and the plunger portion of elastomeric dome being configurable to impinge the dome portion of the collapsible metal dome when depressed from above and to not contact the dome portion of the metal dome when in a relaxed state; and attaching key cap to the elastomeric dome such that the plunger portion extends from an underside of the key cap.

9. The method of claim 8, wherein the elastomeric dome and the metal dome are substantially concave and oriented in a substantially same direction.

10. The method of claim 8, wherein the elastomeric dome and the metal dome have a substantially same diameter.

11. The method of claim 8, wherein a total travel distance of the keyboard is less than about 1.5 mm.

12. The method of claim 8, wherein the metal dome and the elastomeric dome provide a combined quick force drop when the metal dome and the elastomeric dome are collapsed.

13. A tactile low-travel keyboard for a computing device, comprising:

a membrane comprising a top layer having a first contact attached to an underside of the top layer, a bottom layer having a second contact attached to a top side of the bottom layer, and a spacer layer between the top and bottom layers having a void between the first and second contacts;

a metal dome comprising a dome portion and a first base portion, the metal dome being disposed over the membrane and collapsible when depressed from above, the metal dome being configured to contact the top layer of the membrane to connect the first and second contacts when the metal dome is deformed;

an elastomeric dome disposed over the metal dome and collapsible when depressed from above, the elastomeric dome comprising a second base portion, the second base portion of the elastomeric dome being configured to attach to the first base portion of the metal dome, the elastomeric dome and the metal dome being oriented in a substantially same direction; and a key cap disposed over the collapsible elastomeric dome and comprising a plunger portion extending from an underside of the key cap, the key cap being attached to the collapsible elastomeric dome, wherein the key cap contacts both the collapsible metal dome and the collapsible elastomeric dome when the key cap is depressed, the plunger portion being operable to collapse the dome portion of the metal dome into contact with the membrane to connect the first and second contacts, and the plunger portion being operable to not contact the dome portion of the metal dome when in a relaxed state.

14. The tactile low-travel keyboard of claim 13, further comprising a movable scissor mechanism attaching the key cap to the membrane.

15. The tactile low-travel keyboard of claim 13, wherein the keyboard has a travel distance of less than about 1.5 mm.

16. The tactile low-travel keyboard of claim 13, wherein the metal dome and the elastomeric dome have a substantially same diameter.

17. The tactile low-travel keyboard of claim 13, wherein the elastomeric dome comprises silicone.

18. The tactile low-travel keyboard of claim 13, wherein the metal dome comprises stainless steel.

19. The tactile low-travel keyboard of claim 13, wherein the electrical switch circuitry comprises conductive traces that contact one another when the electrical switch circuitry is activated.

20. A key for a keyboard, comprising:

a key cap;

a collapsible elastomeric dome comprising a first base portion and a plunger portion, the elastomeric dome being attached to and extending from an underside of the key cap;

a collapsible metal dome comprising a dome portion and a second base portion, the second base portion being attached to the first base portion of the elastomeric dome, the second base portion of the metal dome being disposed beneath the elastomeric dome and oriented in a substantially same direction as the elastomeric dome, the plunger portion of the elastomeric dome configured to not contact the dome portion of the metal dome when the elastomeric dome is in a relaxed state; and a membrane comprising a top layer having a first contact attached to an underside of the top layer, a bottom layer having a second contact attached to a top side of the bottom layer, and a spacer layer between the top and bottom layers having a void between the first and second contacts, the second base portion of the metal dome being attachable to the membrane, wherein when the key is fully depressed the elastomeric dome collapses and the plunger portion of the elastomeric dome impinges on the dome portion of the metal dome and collapses the metal dome into contact with the membrane to connect the first and second contacts.

21. The key of claim 20, further comprising: a scissor mechanism attached to the key cap and the membrane.

* * * * *